US006845539B2

(12) United States Patent
Tubman

(10) Patent No.: US 6,845,539 B2
(45) Date of Patent: Jan. 25, 2005

(54) MULTIPURPOSE BRUSH

(76) Inventor: Louis Tubman, 2301 Cherry St., Philadelphia, PA (US) 19102

( * ) Notice: Subject to any disclaimer, the term of this patent is extended or adjusted under 35 U.S.C. 154(b) by 0 days.

(21) Appl. No.: 10/322,477

(22) Filed: Dec. 19, 2002

(65) Prior Publication Data

US 2004/0117933 A1 Jun. 24, 2004

(51) Int. Cl.[7] ..... A46B 5/00; A46B 9/00

(52) U.S. Cl. ..... 15/159.1; 15/143.1; 15/144.4; 15/160; 15/164

(58) Field of Search ..... 15/144.4, 159.1, 15/160, 164, 143.1; D4/127, 128, 130, 132–134

(56) References Cited

U.S. PATENT DOCUMENTS

| | | | | | |
|---|---|---|---|---|---|
| 676,845 | A | | 6/1901 | Leiner | 15/164 |
| 1,660,318 | A | | 2/1928 | Anderson | 15/164 |
| D160,415 | S | | 10/1950 | Moser | D28/63 |
| 2,899,225 | A | | 8/1959 | Birr | 403/58 |
| 3,433,510 | A | | 3/1969 | Hulterstrum | 403/77 |
| 3,820,187 | A | | 6/1974 | Numbers et al. | 15/244.2 |
| D247,212 | S | | 2/1978 | Welch | D32/51 |
| 4,475,262 | A | | 10/1984 | Downer | 15/210.1 |
| D336,372 | S | | 6/1993 | Ricciarelli et al. | D4/138 |
| 5,353,463 | A | * | 10/1994 | Bracy, Jr. | 15/160 |
| 5,381,577 | A | | 1/1995 | Lilja | 15/49.1 |
| D357,586 | S | * | 4/1995 | Tubman | D4/133 |
| 5,402,550 | A | | 4/1995 | Lessard | 15/143.1 |
| D359,625 | S | | 6/1995 | Hoagland | D4/138 |
| D404,982 | S | | 2/1999 | Fluent | D8/11 |
| 5,878,459 | A | * | 3/1999 | McParland | 15/114 |
| 5,984,090 | A | * | 11/1999 | Banfield | 206/223 |
| 5,984,100 | A | | 11/1999 | Ramsey et al. | 206/581 |
| 5,984,555 | A | | 11/1999 | Samad | 401/176 |
| 6,154,913 | A | * | 12/2000 | Burton | 15/160 |

* cited by examiner

*Primary Examiner*—Mark Spisich
(74) *Attorney, Agent, or Firm*—Welsh & Flaxman LLC

(57) ABSTRACT

A multipurpose brush includes a brush head and a handle coupled to and extending from the brush head. The brush head includes a central core member. The central core member includes a top surface, a bottom surface, a rear surface and a front surface, wherein the central core member also includes a central longitudinal axis. The brush head further includes bristles extending from the top surface, bottom surface and front surface of the central core member. The bristles extending from the top surface define an upper brushing surface at distal ends of the bristles which is approximately 5° to 20° relative to the central longitudinal axis and the bristles extending from the bottom surface define a lower brushing surface at distal ends of the bristles which is approximately 5° to 20° relative to the central longitudinal axis. A set of brushes is also provided in accordance with the present invention.

17 Claims, 5 Drawing Sheets

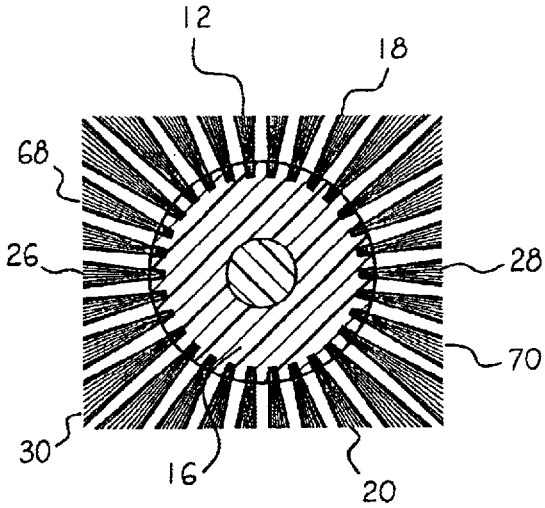
FIG.3
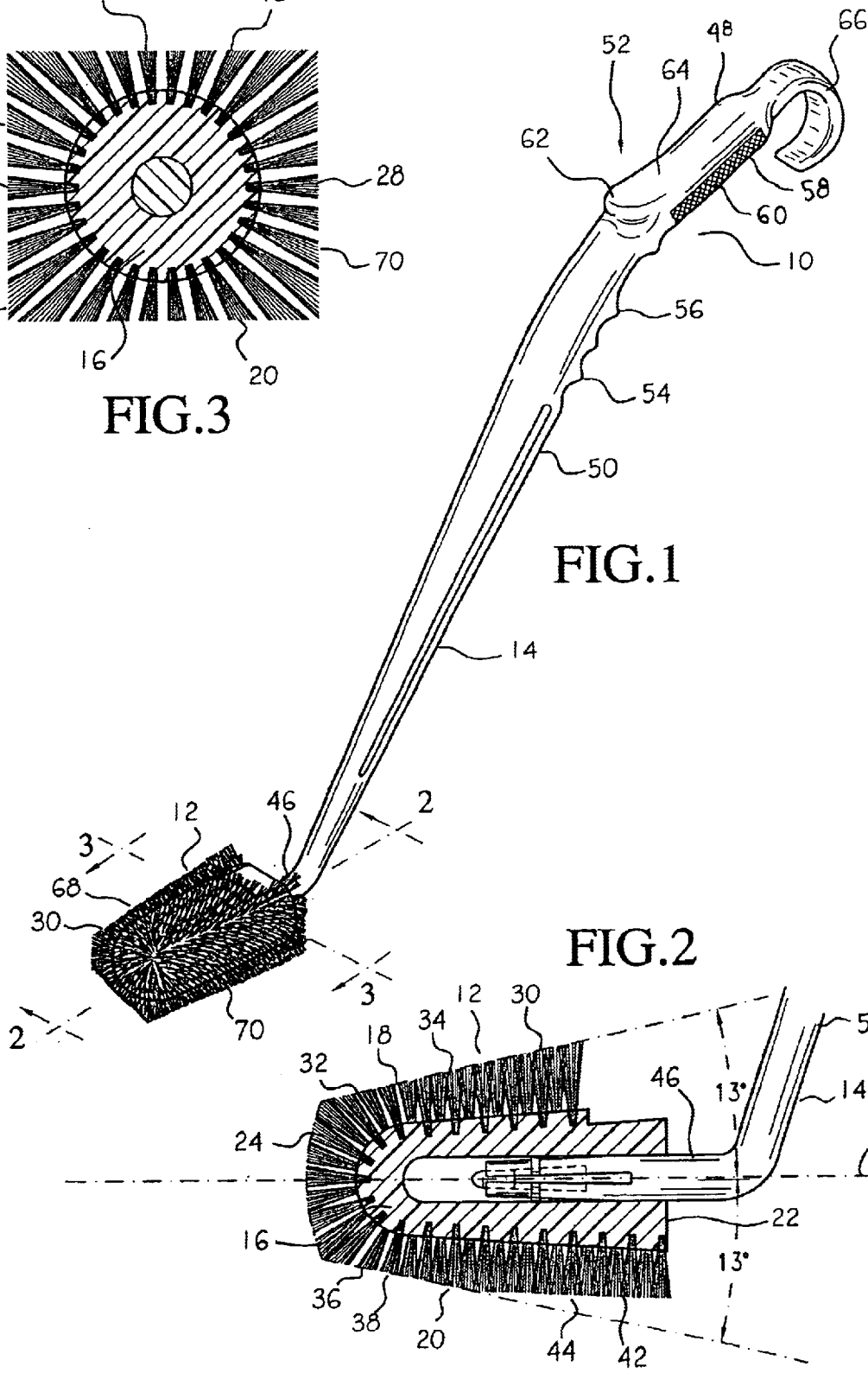
FIG.1
FIG.2

MULTIPURPOSE BRUSH

BACKGROUND OF THE INVENTION

1. Field of the Invention

The invention relates to a multipurpose brush having an angled brush head so as to provide for improved functionality. The invention further relates to a set of brushes configured for optimally cleaning a specific environment.

2. Description of the Prior Art

Many brushes have been developed over the years for addressing the cleaning concerns of individuals. However, a need still exists for an effective, easy to use multipurpose brush adapted for cleaning the wide range of surfaces found in a common household bathroom or kitchen. The present brush addresses this ongoing problem by providing a brush offering a plurality of cleaning surfaces optimized to effectively help an individual clean the many different surfaces found in a common household bathroom or kitchen.

SUMMARY OF THE INVENTION

It is, therefore, an object of the present invention to provide a multipurpose brush. The brush includes a brush head and a handle coupled to and extending from the brush head. The brush head includes a central core member. The central core member includes a top surface, a bottom surface, a rear surface and a front surface, wherein the central core member also includes a central longitudinal axis. The brush head further includes bristles extending from the top surface, bottom surface and front surface of the central core member. The bristles extending from the top surface define an upper brushing surface at distal ends of the bristles which is approximately 5° to 20° relative to the central longitudinal axis and the bristles extending from the bottom surface define a lower brushing surface at distal ends of the bristles which is approximately 5° to 20° relative to the central longitudinal axis.

It is also an object of the present invention to provide a multipurpose brush wherein the upper brushing surface is approximately 13° relative to the central longitudinal axis and the lower brushing surface is approximately 13° relative to the central longitudinal axis.

It is another object of the present invention to provide a multipurpose brush wherein the handle is generally S-shaped.

It is a further object of the present invention to provide a multipurpose brush wherein the handle is between approximately 28" and 30" in length.

It is yet another object of the present invention to provide a multipurpose brush wherein the handle includes a distal segment directly coupled to the rear surface of the central core member, a proximal segment remote from the rear surface of the central core member and a central segment connecting the distal segment to the proximal segment.

It is also another object of the present invention to provide a multipurpose brush wherein the distal segment is substantially aligned with the central longitudinal axis of the central core member.

It is still a further object of the present invention to provide a multipurpose brush wherein the central segment is oriented at an angle of approximately 125° relative to the distal segment and the central segment is oriented at an angle of approximately 160° relative to the proximal segment.

It is also an object of the present invention to provide a multipurpose brush wherein the central core member further includes a first side surface extending between the top surface and the bottom surface and a second side surface extending between the top surface and the bottom surface. The brush head further includes bristles extending from the first side surface and the second side surface, wherein the bristles extending from the first side surface define a first side brushing surface and the bristles extending from the second side surface define a second side brushing surface, and wherein the intersection of the first side brushing surface with the respective upper brushing surface and lower brushing surface is squared so as to define pointed corner surfaces and wherein the intersection of the second side brushing surface with the respective upper brushing surface and lower brushing surface is squared so as to define pointed corner surfaces.

It is another object of the present invention to provide a multipurpose brush wherein the central core member further includes a first side surface extending between the top surface and the bottom surface and a second side surface extending between the top surface and the bottom surface. The brush head further includes bristles extending from the first side surface and the second side surface, wherein the bristles extending from the first side surface define a first side brushing surface and the bristles extending from the second side surface define a second side brushing surface, and wherein the intersection of the first side brushing surface with the respective upper brushing surface and lower brushing surface is rounded so as to define rounded corner surfaces and wherein the intersection of the second side brushing surface with the respective upper brushing surface and lower brushing surface is rounded so as to define rounded corner surfaces.

It is a further object of the present invention to provide a set of brushes allowing for multipurpose cleaning.

It is yet a further object of the present invention to provide a multipurpose brush including a brush head and a handle coupled to and extending from the brush head. The handle includes a first member and a second member which are selectively coupled so as to permit adjustment of the length of the handle.

It is also an object of the present invention to provide a multipurpose brush wherein the first member and the second member are telescopically coupled.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view of a first embodiment of the present brush.

FIG. 2 is a cross sectional view along the line 2—2 as shown in FIG. 1.

FIG. 3 is a cross sectional view along the line 3—3 as shown in FIG. 1.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 3, a multipurpose brush 10 is disclosed. The brush 10 generally includes a brush head 12 and a handle 14 coupled to and extending from the brush head 12. The brush head 12 is configured so as to allow for the use of the present brush in a variety of orientations and for a variety of purposes without necessitating that the user unduly exert himself or herself. Thereby, the present bush (es) has been designed to minimize extreme and/or awkward body positioning typically required of the users of currently available brushes.

Figures 9, 10:
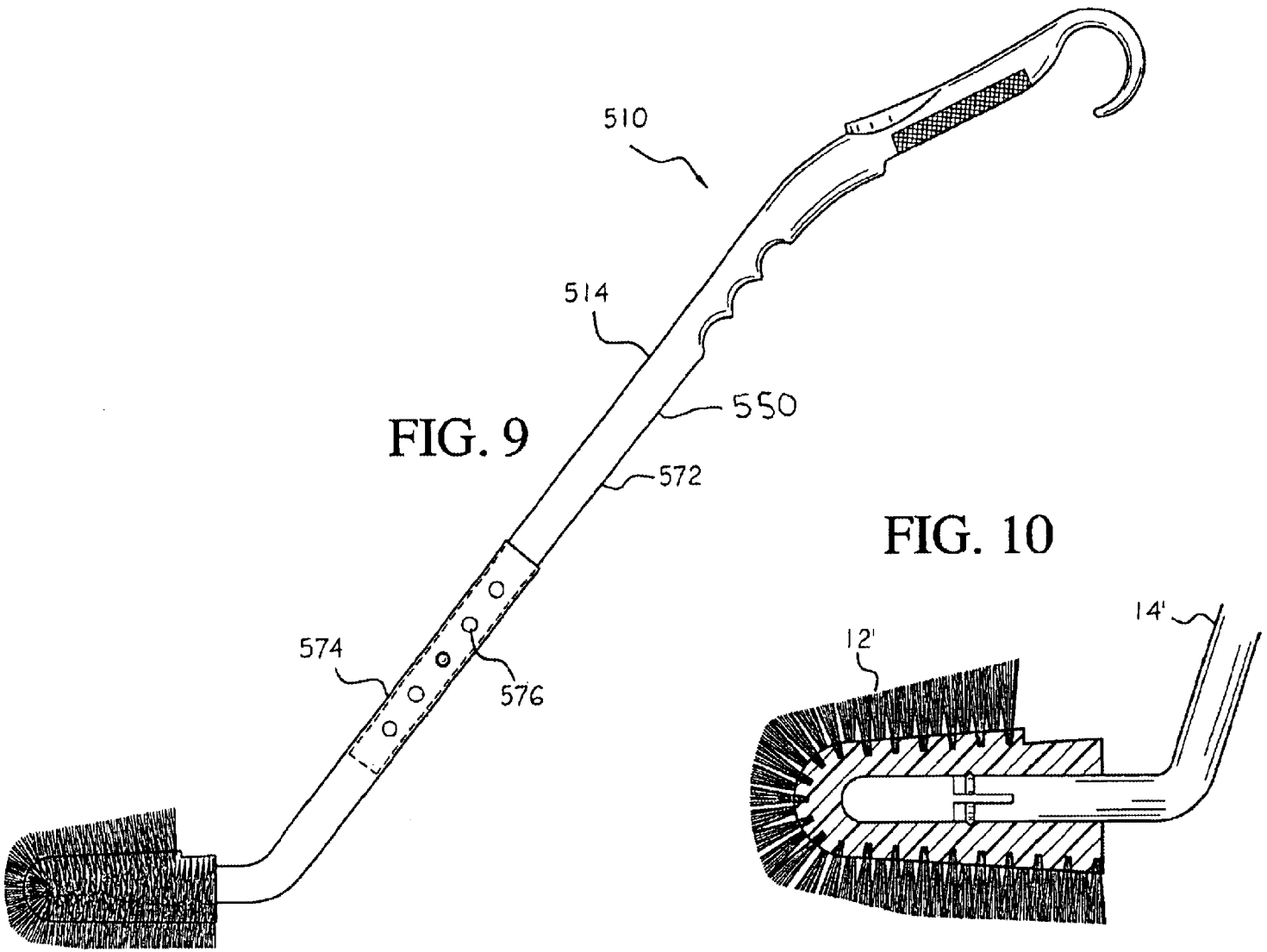
FIG. 9 is a side view of an alternate embodiment in accordance with the present invention.
FIG. 10 is a cross sectional view of a brush employing a pivotal connection between the brush head and the handle.

In accordance with alternate embodiments, and as respectively shown in FIGS. 10 and 2, the brush head 12' may be connected to the handle 14' so as to permit rotational movement therebetween (see FIG. 10) or to fixedly hold the brush head 12 relative to the handle 14 (see FIG. 2). In accordance with the rotating embodiment disclosed in FIG. 10, the handle 14' is connected to the brush head 12' through the use of a traditional swivel connection. Where a swivel is utilized as with the embodiment disclosed with reference to FIG. 10, stops may be employed so as to control the permitted rotation and aid individuals in the use of the present brush.

In accordance with the embodiment disclosed in FIG. 2, the handle 14 is fixedly connected to the brush head 12 through the use of a key lock mechanism interposed between the handle 14 and the brush head 12. The brush head may similarly be connected through the use of a typical screw thread design or glue/weld design. While specific mechanisms are proposed above (and in the following discussion) for the connection of the brush head to the handle, those skilled in the art will readily appreciate the various ways in which the handle may be connected to the brush head without departing from the spirit of the present invention.

With reference to the brush head 12 in accordance with a preferred embodiment of the present invention (see FIGS. 1 to 3), the brush head 12 includes a central core member 16. The central core member 16 includes a top surface 18, a bottom surface 20, a rear surface 22 and a front surface 24. The central core member 16 also includes a first side surface 26 extending between the top surface 18 and the bottom surface 20 and a second side surface 28 extending between the top surface 18 and the bottom surface 20. As shown in FIGS. 2 and 3, the central core member 16 is substantially circular in cross section. However, it is contemplated that the central core member may also be structured with a substantially rectangular cross section. The use of a cylindrical central core member reduces the weight of the central core member and reduces the cost of manufacture associated with the central core member.

The brush head 12 further includes bristles 30 extending from the top surface 18, bottom surface 20 and front surface 24 of the central core member 16. The bristles 30 extending from the forward portion 32 of the top surface 18 are cut to define an upper brushing surface 34 at distal ends of the bristles 30. The upper brushing surface 34 is angled to be approximately 5° to 20° relative to the central longitudinal axis 35, and preferably 13°. Similarly, the bristles extending from the forward portion 36 of the bottom surface 20 are shaped to define a lower brushing surface 38 at distal ends of the bristles 30. The lower brushing surface 38 is also approximately 5° to 20° relative to the central longitudinal axis 35, and preferably 13°.

The effectiveness of the present brush 10 is further enhanced by the bristles (or lack thereof) at positions along a rear portion 42 of both the top surface 18 and bottom surface 20 of the central core member 16. Specifically, the rear portion 42 of the top surface 18 is free of bristles. By providing a rear portion 42 of the top surface 18 which is free of bristles, the weight of the present brush 10 is substantially reduced, enhancing the overall positioning flexibility, usability and versatility of the present brush 10.

The rear portion 42 of the bottom surface 20 is similarly configured to enhance the usefulness and versatility of the present brush 10. Specifically, the rear portion 42 of the bottom surface is provided with bristles 30. However, the bristles are cut so as to define a secondary lower brushing surface 44 which is substantially parallel to the central longitudinal axis 35 of the central core member 16. By orienting the secondary lower brushing surface 44 in this manner, the brush 10 is configured so as to facilitate ease of use on further surfaces in a manner which will be discussed below in greater detail.

As mentioned above, the upper and lower brushing surfaces 34, 38 are oriented at angles of approximately 5° to 20° relative to the central longitudinal axis 35. In accordance with a preferred embodiment of the present invention, the upper brushing surface 34 is approximately 13° relative to the central longitudinal axis 35 and the lower brushing surface 38 is approximately 13° relative to the central longitudinal axis 35.

With regard to the handle 14, it is also shaped to enhance the usefulness of the present brush 10 and provide for optimal versatility. With this in mind, the handle 10 is generally S-shaped. Specifically, the handle 10 includes a distal segment 46 directly coupled to the rear surface 22 of the central core member 16, a proximal segment 48 remote from the rear surface 22 of the central core member 16 and a central segment 50 connecting the distal segment 46 to the proximal segment 48.

The distal segment 46 is substantially aligned with the central longitudinal axis 35 of the central core member 16, and the central segment 50 and proximal segment 48 extend therefrom. In accordance with a preferred embodiment of the present invention, the central segment 50 is oriented at approximately an angle of approximately 125° relative to the distal segment 46 and the central segment 50 is oriented at an angle of approximately 160° relative to the proximal segment 48. While specific angular orientations are disclosed herein, those skilled in the art will appreciate the variation in those orientations which might be employed to expand upon the versatility and usefulness of the present brush.

The handle 12 is further provided with various gripping surfaces 52. The gripping surfaces 52 may be knurled or textured to enhance the usefulness of the present brush. The usefulness of the various gripping surfaces 52 will become apparent as the functionality of the present brush 10 is described below in detail. Specifically, a first gripping surface 54 is provided in the rear side 56 of the central segment 50 at a position adjacent the proximal segment 48 of the handle 12. A second gripping surface 58 is provided on the rear side 60 of the proximal segment 48 adjacent the central segment 50 of the handle 14. The second gripping surface 58 is further provided with a cooperating thumb recess 62 formed along the front side 64 of the proximal segment 48. A hanging loop 66 is also provided at the free end of the proximal segment 48.

The usefulness of the present brush 10 is further enhanced by altering the details associated with the junction between the upper and lower brushing surfaces 34, 38 and the side brushing surfaces 68, 70. Specifically, and as briefly discussed above, the central core member 16 further includes a first side surface 26 extending between the top surface 18 and the bottom surface 20 and a second side surface 28 extending between the top surface 18 and the bottom surface 20, the brush head 12 further includes bristles 30 extending from the first side surface 26 and the second side surface 28, wherein the bristles 30 extending from the first side surface 26 define a first side brushing surface 68 and the bristles 30 extending from the second side surface 28 define a second side brushing surface 70.

In accordance with a first embodiment disclosed with reference to FIGS. 1 and 3, the intersection of the first side brushing surface 68 with the respective upper brushing surface 34 and lower brushing surface 38 is squared so as to define pointed corner surfaces. Similarly, the intersection of the second side brushing surface 70 with the respective upper brushing surface 34 and lower brushing surface 38 is squared so as to define pointed corner surfaces.

Figure 6:
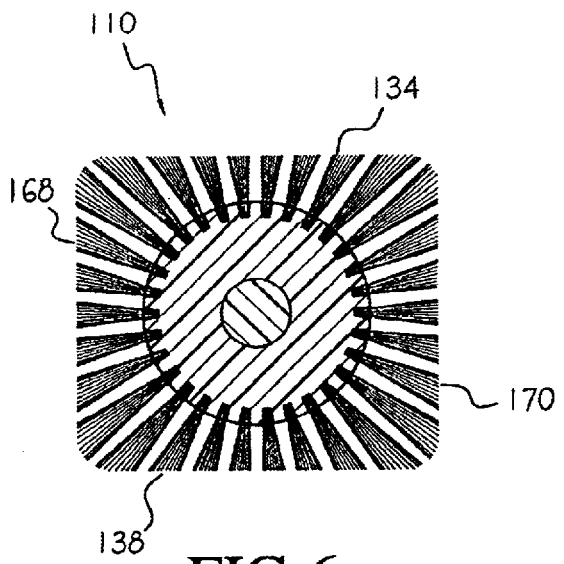
FIG. 6 is a cross sectional view along the line 6—6 as shown in FIG. 4.
Figure 4:
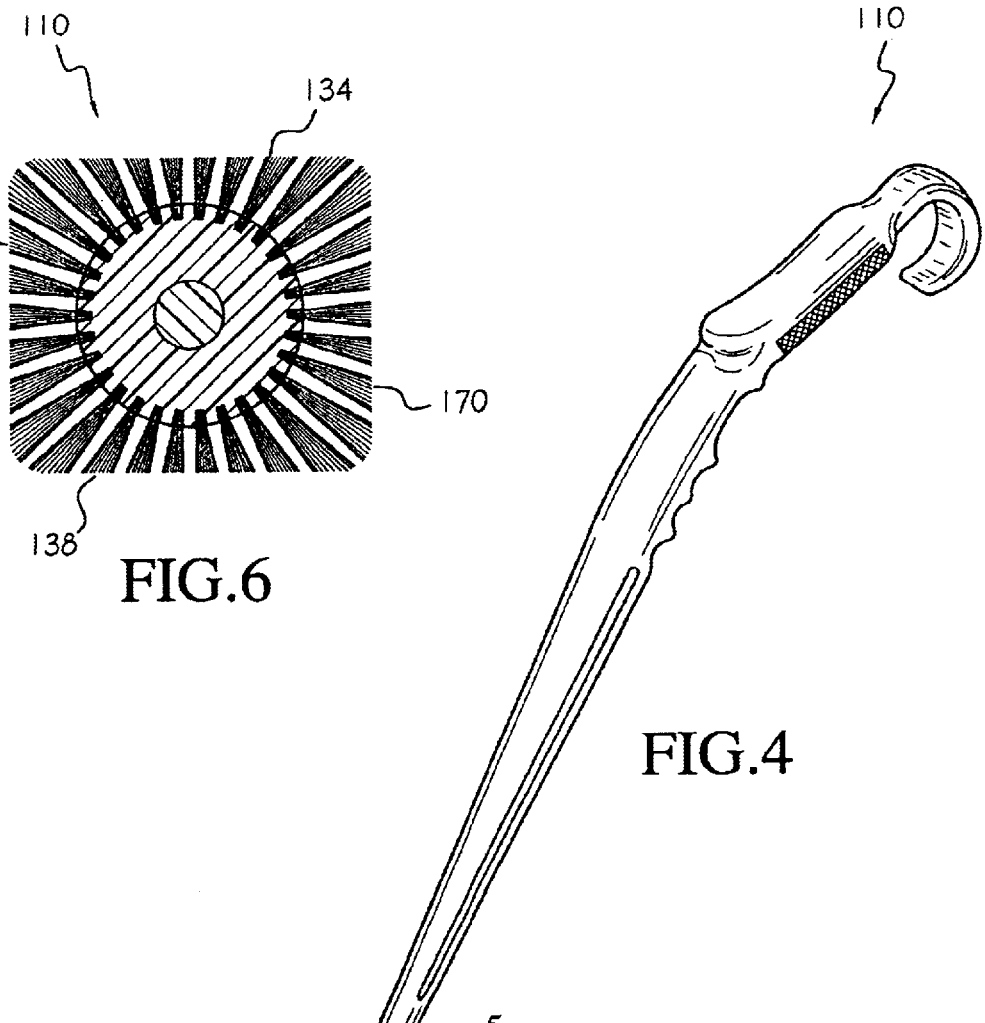
FIG. 4 is a perspective view of a second embodiment of the present brush.
Figure 5:
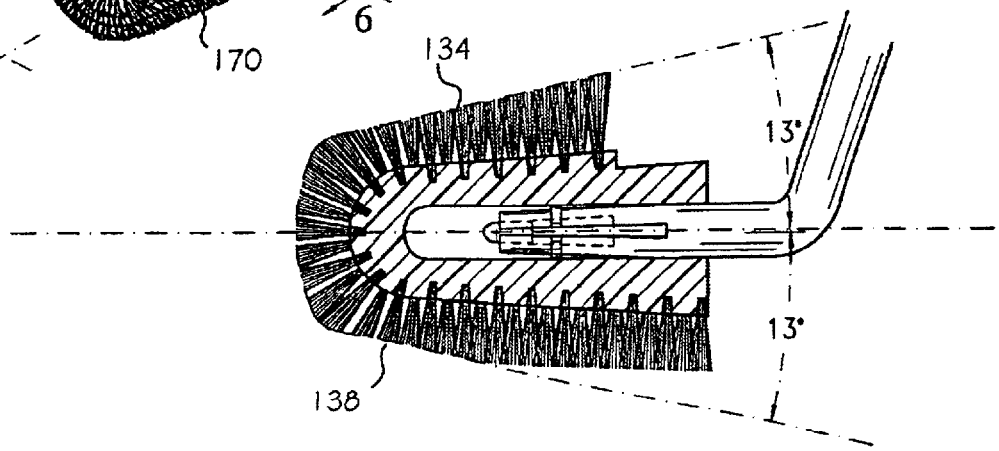
FIG. 5 is a cross sectional view of the brush along line 5—5 as shown in FIG. 4.

In accordance with a further embodiment of the brush 110 as disclosed with reference to FIGS. 4 to 6, the intersection of the first side brushing surface 168 with the respective upper brushing surface 134 and lower brushing surface 138 is rounded so as to define rounded corner surfaces. Similarly, the intersection of the second side brushing surface 170 with the respective upper brushing surface 134 and lower brushing surface 138 is rounded so as to define rounded corner surfaces.

As the various embodiments of the present brush 10, 110 are adapted for use in performing different functions, it is further contemplated that brushes 10, 110 will be constructed in various lengths. In accordance with a preferred embodiment of the present invention, the rounded edge brushes disclosed with reference to FIGS. 4 to 6, will be constructed with a length of approximately 30", while the square edged brushes (see FIGS. 1 to 3) will be constructed with a length of approximately 28". However, those skilled in the art will certainly appreciate other lengths that may be employed without departing from the spirit of the present invention.

Figure 7:
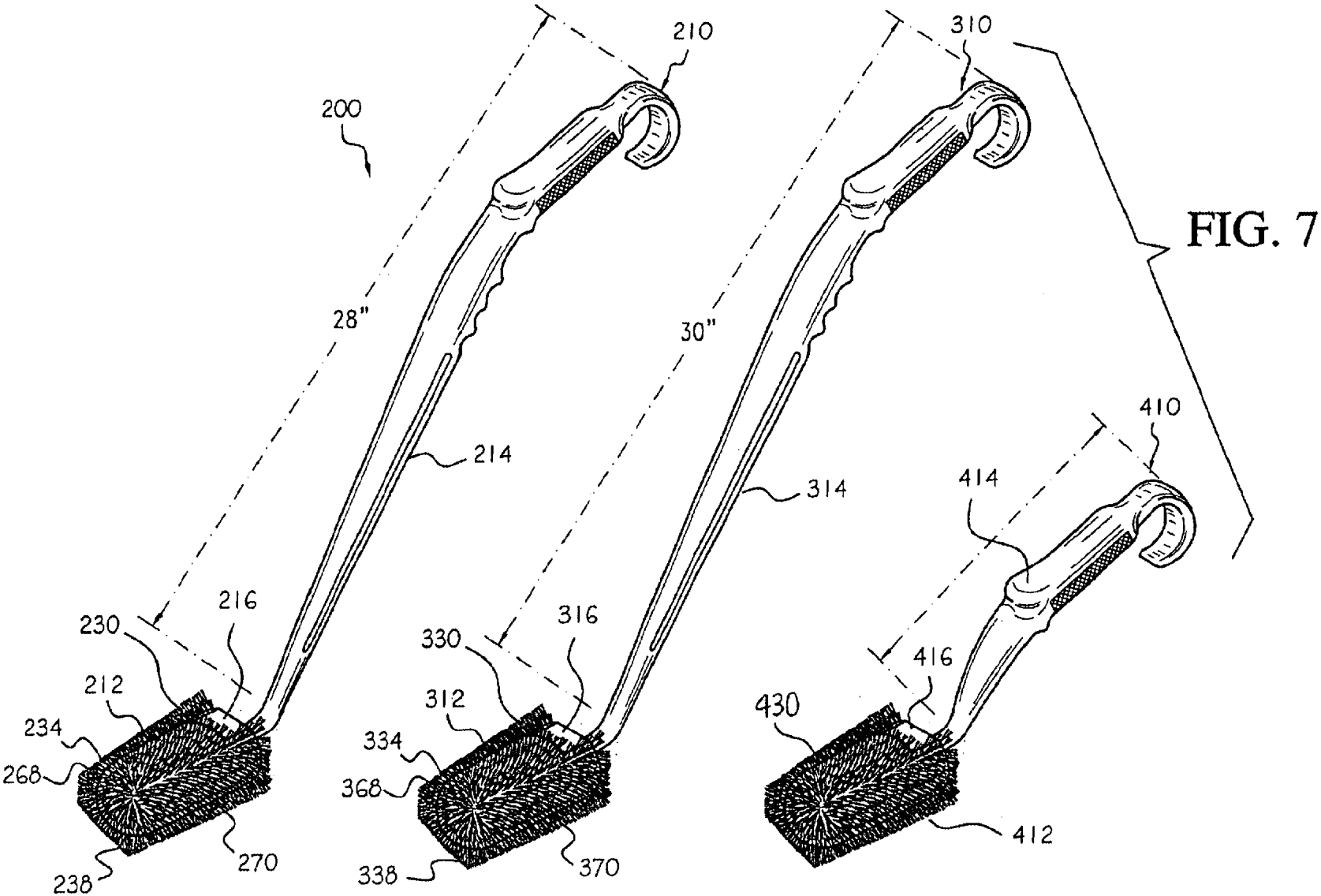
FIG. 7 is a perspective view of a set of brushes in accordance with the present invention.

In addition to the specific multipurpose brushes 10, 110 described above, the present invention also relates to a set of brushes 200 allowing for multipurpose cleaning (see FIG. 7). The set of brushes 200 is generally composed of three brushes designed to take care of a series of applications. For example, a first set of brushes in accordance with the present invention is designed for assisting an individual to conduct a complete cleaning of a bathtub and the surrounding area, while a second set of brushes is designed for assisting an individual to conduct a complete cleaning of a toilet and the surrounding area.

In general, the set of brushes 200 is composed of a first brush 210 including a brush head 212 and a handle 214 coupled to and extending from the brush head 212. The brush head 212 includes a central core member 216. As with the embodiment disclosed with reference to FIGS. 1 to 3, the central core member 216 includes a top surface, a bottom surface, a first side surface extending between the top surface and the bottom surface, a second side surface extending between the top surface and the bottom surface, a rear surface and a front surface. The central core member 216 also includes a central longitudinal axis. The brush head 212 further includes bristles 230 extending from the top surface, bottom surface, first side surface, second side surface and front surface of the central core member 216. The bristles 230 extending from the top surface define an upper brushing surface 234 at distal ends of the bristles 230. The bristles 230 extending from the bottom surface define a lower brushing surface 238. The bristles 230 extending from the first side surface 268 define a first side brushing surface and the bristles 230 extending from the second side surface define a second side brushing surface 270. The intersection of the first side brushing surface 268 with the respective upper brushing surface 270 and lower brushing surface 238 is squared so as to define pointed corner surfaces with the intersection of the second side brushing surface 270 and the respective upper brushing surface 234 and lower brushing surface 238 is squared so as to define pointed corner surfaces.

As to the second brush 310, it includes a brush head 312 and a handle coupled 314 to and extending from the brush head 312. The brush head includes a central core member 316. As with the embodiment disclosed with reference to FIGS. 4 to 6, the central core member 316 includes a top surface, a bottom surface, a first side surface extending between the top surface and the bottom surface, a second side surface extending between the top surface and the bottom surface, a rear surface and a front surface. The central core member 316 also includes a central longitudinal axis. The brush head 312 further includes bristles 330 extending from the top surface, bottom surface, first side surface, second side surface and front surface of the central core member 316. The bristles 330 extending from the top surface define an upper brushing surface 334 at distal ends of the bristles. The bristles 330 extending from the bottom surface define a lower brushing surface 338. The bristles 330 extending from the first side surface define a first side brushing surface 368 and the bristles 330 extending from the second side surface define a second side brushing surface 370. The intersection of the first side brushing surface 368 with the respective upper brushing surface 334 and lower brushing surface 338 is rounded so as to define rounded corner surfaces and the intersection of the second side brushing surface 370 with the respective upper brushing surface 334 and lower brushing surface 338 is rounded so as to define rounded corner surfaces.

The third brush 410 includes a brush head 412 with a central core member 416 and bristles 430 extending therefrom and a handle 414 coupled to and extending from the brush head. However, the handle is at least 40% shorter than handles of the first and second brushes.

With regard to the first and second brushes 210, 310 the construction of the brush heads and handles is similar to that disclosed with reference to the embodiment disclosed in FIGS. 1 to 6. As such, these brushes are designed for ease of use and application in achieving a wide variety of functions. As to the third brush 410, it may adopt the construction elements applied in the embodiment disclosed with reference to FIGS. 1 to 6, or it may be otherwise designed as those skilled in the art will certainly appreciate.

With regard to the set of brushes designed for cleaning a bathtub and the surrounding area, the set is composed of a 30" second brush 310 having rounded edges, a 28" first brush 210 having squared edges and a third brush 410 specifically designed for cleaning a sink top. In particular, the rounded edges of the 30" second brush 310 are applied to this brush as it is intended for use in cleaning the inside and surround of the bathtub itself. The square edges of the 28" first brush 210 are applied to this brush as it is intended for cleaning the flooring surrounding the bathtub or the flat surface of the floor within the bathtub or the floor and walls of a stall shower.

With regard to the set of brushes designed for cleaning a toilet and the surrounding area, the set is composed of a 30" second brush (with telescoping handle and circular head, see FIG. 9) 310 having rounded edges, a 28" first brush 210 having square edges and a third brush 410 specifically designed for cleaning the top of toilet. In particular, the rounded edges of the 30" second brush 310 are applied to this brush as it is intended for use in cleaning the inside of the toilet itself. The square edges of the 28" brush 210 are applied to this brush as it is intended for cleaning the flooring surrounding the toilet.

In accordance with a further embodiment of the present invention, and as shown in FIG. 9, the brush 510 may be designed to provide for ready adjustment of the handle 514 length. Specifically, the central segment 550 is split to define a handle 514 including a first member 572 and a second member 574. The first and second members 572, 574 are selectively coupled so as to permit adjustment of the length of the handle 514. In accordance with a preferred embodiment of the present invention, the first member 572 is telescopically received within the second member 574 and a locking member 576 along the second member 574 is used to lock the first and second members 572, 574 relative to each other.

Figure 8:
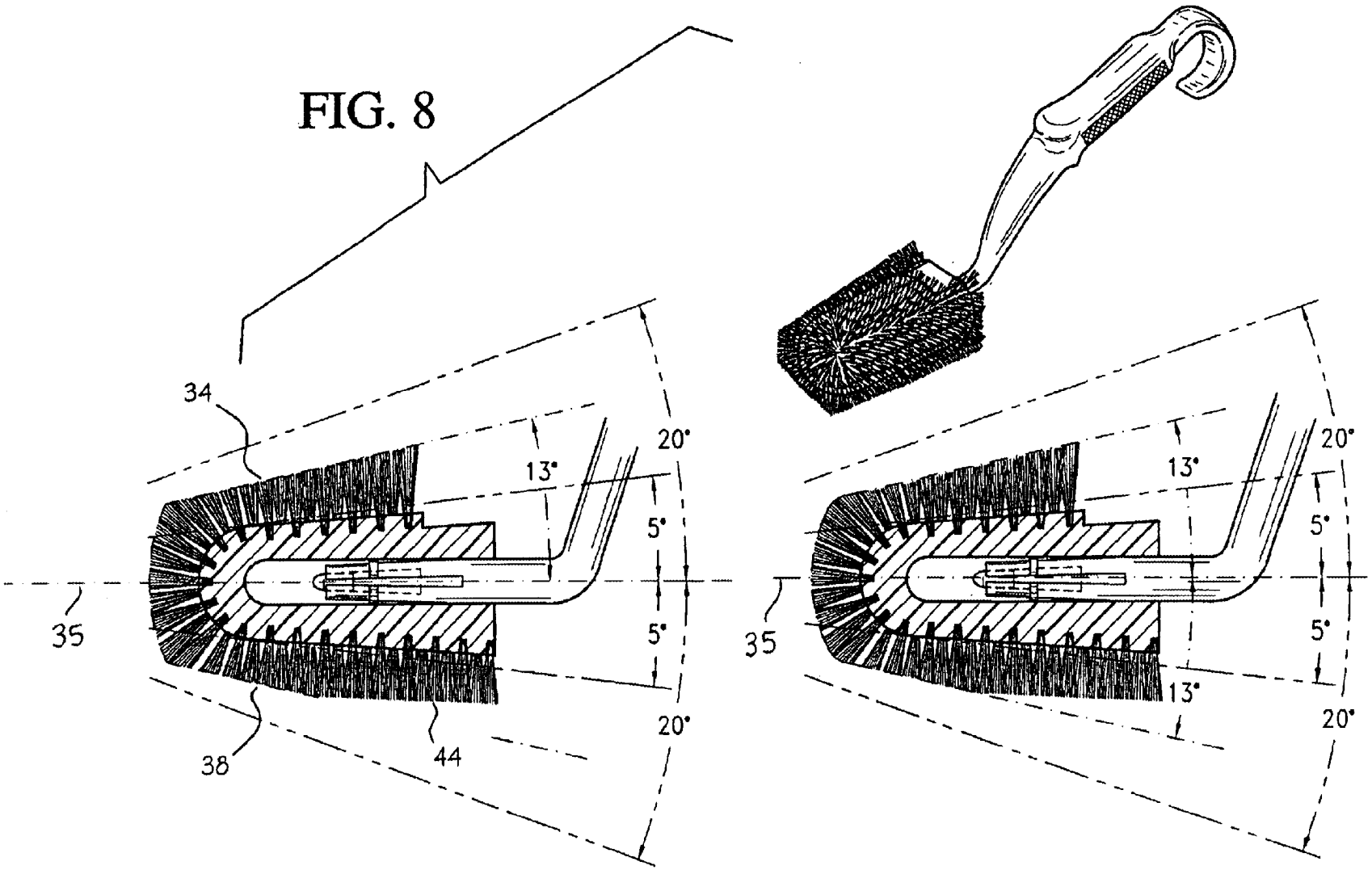
FIG. 8 is an explempary view showing the range of brush angles contemplated in accordance with the present invention.

As discussed above, the brushes of the present invention are adapted for a wide range of uses. As shown in FIG. 8, the angled head of the brush allows one to readily clean a variety of horizontal, vertical or angled surfaces without unduly exerting the user of the brush.

The brush head's final trim may vary slightly from that presented in the attached drawings, depending upon the specific surface or area, in the bathroom or kitchen, it is configured to scrub clean.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A multipurpose brush, comprising:

a brush head; and an S-shaped handle coupled to and extending from the brush head;

the brush head includes a central core member, the central core member includes a top surface, a bottom surface, a rear surface and a front surface, wherein the central core member also includes a central longitudinal axis;

the brush head further includes bristles extending from the top surface, bottom surface and front surface of the central core member, the bristles extending from the top surface define a substantially planar upper brushing surface at distal ends of the bristles which is approximately 5° to 20° relative to the central longitudinal axis and the bristles extending from the bottom surface define a substantially planar lower brushing surface at distal ends of the bristles which is approximately 5° to 20° relative to the central longitudinal axis.

2. The multipurpose brush according to claim 1, wherein the upper brushing surface is approximately 13° relative to the central longitudinal axis and the lower brushing surface is approximately 13° relative to the central longitudinal axis.

3. The multipurpose brush according to claim 1, wherein the handle is between approximately 28" and 30" in length.

4. The multipurpose brush according to claim 1, wherein the handle includes a distal segment directly coupled to the rear surface of the central core member, a proximal segment remote from the rear surface of the central core member and a central segment connecting the distal segment to the proximal segment.

5. The multipurpose brush according to claim 4, wherein the distal segment is substantially aligned with the central longitudinal axis of the central core member.

6. The multipurpose brush according to claim 5, wherein the central segment is oriented at an angle of approximately 125° relative to the distal segment and the central segment is oriented at an angle of approximately 160° relative to the proximal segment.

7. The multipurpose brush according to claim 4, wherein the handle is between approximately 28" and 30" in length.

8. A multipurpose brush, comprising:

a brush head; and a handle coupled to and extending from the brush head;

the brush head includes a central core member, the central core member includes a top surface, a bottom surface, a rear surface and a front surface, wherein the central core member also includes a central longitudinal axis;

the brush head further includes bristles extending from the top surface, bottom surface and front surface of the central core member, the bristles extending from the top surface define an upper brushing surface at distal ends of the bristles which is approximately 5° to 20° relative to the central longitudinal axis and the bristles extending from the bottom surface define a lower brushing surface at distal ends of the bristles which is approximately 5° to 20° relative to the central longitudinal axis;

wherein the central core member further includes a first side surface extending between the top surface and the bottom surface and a second side surface extending between the top surface and the bottom surface, the brush head further includes bristles extending from the first side surface and the second side surface, wherein the bristles extending from the first side surface define a first side brushing surface and the bristles extending from the second side surface define a second side brushing surface, and wherein the intersection of the first side brushing surface with the respective upper brushing surface and lower brushing surface is squared so as to define pointed corner surfaces and wherein the intersection of the second side brushing surface with the respective upper brushing surface and lower brushing surface is squared so as to define pointed corner surfaces.

9. A multipurpose brush, comprising:

a brush head; and a handle coupled to and extending from the brush head;

the brush head includes a central core member, the central core member includes a top surface, a bottom surface, a rear surface and a front surface, wherein the central core member also includes a central longitudinal axis;

the brush head further includes bristles extending from the top surface, bottom surface and front surface of the central core member, the bristles extending from the top surface define an upper brushing surface at distal ends of the bristles which is approximately 5° to 20° relative to the central longitudinal axis and the bristles extending from the bottom surface define a lower brushing surface at distal ends of the bristles which is approximately 5° to 20° relative to the central longitudinal axis;

wherein the central core member further includes a first side surface extending between the top surface and the bottom surface and a second side surface extending between the top surface and the bottom surface, the brush head further includes bristles extending from the first side surface and the second side surface, wherein the bristles extending from the first side surface define a first side brushing surface and the bristles extending from the second side surface define a second side brushing surface, and wherein the intersection of the first side brushing surface with the respective upper brushing surface and lower brushing surface is rounded so as to define rounded corner surfaces and wherein the intersection of the second side brushing surface with the respective upper brushing surface and lower brushing surface is rounded so as to define rounded corner surfaces.

10. A set of brushes allowing for multipurpose cleaning, comprising:

a first brush including a brush head and a handle coupled to and extending from the brush head; the brush head including a central core member, the central core member including a top surface, a bottom surface, a first side surface extending between the top surface and the bottom surface, a second side surface extending between the top surface and the bottom surface, a rear surface and a front surface, wherein the central core member also includes a central longitudinal axis, the brush head further includes bristles extending from the top surface, bottom surface, first side surface, second side surface and front surface of the central core member, the bristles extending from the top surface define an upper brushing surface at distal ends of the bristles, the bristles extending from the bottom surface define a lower brushing surface, the bristles extending from the first side surface defining a first side brushing surface and the bristles extending from the second side surface defining a second side brushing surface, wherein the intersection of the first side brushing surface with the respective upper brushing surface and lower brushing surface is squared so as to define pointed corner surfaces and wherein the intersection of the second side brushing surface with the respective upper brushing surface and lower brushing surface is squared so as to define pointed corner surfaces;

a second brush including a brush head and a handle coupled to and extending from the brush head; the brush head including a central core member, the central core member including a top surface, a bottom surface, a first side surface extending between the top surface and the bottom surface, a second side surface extending between the top surface and the bottom surface, a rear surface and a front surface, wherein the central core member also includes a central longitudinal axis, the brush head further includes bristles extending from the top surface, bottom surface, first side surface, second side surface and front surface of the central core member, the bristles extending from the top surface define an upper brushing surface at distal ends of the bristles, the bristles extending from the bottom surface define a lower brushing surface, the bristles extending from the first side surface define a first side brushing surface and the bristles extending from the second side surface define a second side brushing surface, wherein the intersection of the first side brushing surface with the respective upper brushing surface and lower brushing surface is rounded so as to define rounded corner surfaces and wherein the intersection of the second side brushing surface with the respective upper brushing surface and lower brushing surface is rounded so as to define rounded corner surfaces;

a third brush including a brush head with a central core member having a rear surface and a central longitudinal axis, the central core member also includes bristles extending therefrom and a handle coupled to and extending from the brush head, wherein the handle is at least 40% shorter than handles of the first and second brushes.

11. The set of multipurpose brushes according to claim 10, wherein the upper brushing surface of the first brush is oriented at approximately 5° to 20° relative to the central longitudinal axis and the lower brushing surface of the first brush is approximately 5° to 20° relative to the central longitudinal axis and the upper brushing surface of the second brush is oriented at approximately 5° to 20° relative to the central longitudinal axis and the lower brushing surface of the second brush is approximately 5° to 20° relative to the central longitudinal axis.

12. The set of multipurpose brushes according to claim 10, wherein the first brush is shorter than the second brush.

13. The set of multipurpose brushes according to claim 10, wherein the handle of the first brush is approximately 28" and the handle of the second brush is approximately 30".

14. The set of multipurpose brushes according to claim 10, wherein the handles of the respective first brush, second brush and third brushes are S-shaped.

15. The set of multipurpose brushes according to claim 14, wherein each handle includes a distal segment directly coupled to the rear surface of the central core member, a proximal segment remote from the rear surface of the central core member and a central segment connecting the distal segment to the proximal segment.

16. The set of multipurpose brushes according to claim 15, wherein the distal segment is substantially aligned with the central longitudinal axis of the central core member.

17. The set of multipurpose brushes according to claim 16, wherein the central segment is oriented at an angle of approximately 125° relative to the distal segment and the central segment is oriented at an angle of approximately 160° relative to the proximal segment.

* * * * *